US010774463B2

(12) United States Patent
Dunn

(10) Patent No.: US 10,774,463 B2
(45) Date of Patent: Sep. 15, 2020

(54) DRYER APPLIANCE

(71) Applicant: Haier US Appliance Solutions, Inc., Wilmington, DE (US)

(72) Inventor: David Scott Dunn, Smithfield, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 133 days.

(21) Appl. No.: 15/920,766

(22) Filed: Mar. 14, 2018

(65) Prior Publication Data

US 2019/0284749 A1 Sep. 19, 2019

(51) Int. Cl.
*D06F 58/20* (2006.01)
*D06F 58/24* (2006.01)

(52) U.S. Cl.
CPC ..... *D06F 58/206* (2013.01); *D06F 58/24* (2013.01)

(58) Field of Classification Search
CPC ..... D06F 58/206; D06F 58/24
See application file for complete search history.

(56) References Cited

U.S. PATENT DOCUMENTS

2005/0204755 A1* 9/2005 Nishiwaki ..... D06F 58/206 62/93
2008/0235977 A1* 10/2008 Kuwabara ..... D06F 58/206 34/77
2010/0192398 A1* 8/2010 Ahn ..... D06F 58/206 34/79
2014/0109428 A1* 4/2014 Kim ..... D06F 58/206 34/86
2014/0223758 A1* 8/2014 Bison ..... D06F 58/206 34/86
2016/0083896 A1* 3/2016 Ryoo ..... D06F 25/00 68/20
2016/0153135 A1* 6/2016 Ryoo ..... D06F 58/206 34/108
2017/0314181 A1* 11/2017 Wakizaka ..... D06F 58/206
2019/0024299 A1* 1/2019 Ryu ..... B08B 3/02

FOREIGN PATENT DOCUMENTS

CN 105986446 A 10/2016
DE 4409607 A1 * 10/1994 ..... D06F 58/206
JP 2013118946 A 6/2013
WO WO2010003936 A1 1/2010
WO WO2016020852 A1 2/2016

* cited by examiner

*Primary Examiner* — Edelmira Bosques
*Assistant Examiner* — Logan P Jones
(74) *Attorney, Agent, or Firm* — Dority & Manning, P.A.

(57) ABSTRACT

A dryer appliance including a cabinet with a drum rotatably mounted within the cabinet. The drum defines a chamber for the receipt of articles for drying. The dryer appliance also includes a sealed refrigerant circuit in thermal communication with the chamber and a condensation tank configured to receive condensate from an evaporator of the sealed refrigerant circuit. The condensate is selectively in thermal communication with a condenser of the sealed refrigerant circuit.

13 Claims, 8 Drawing Sheets

DRYER APPLIANCE

FIELD OF THE INVENTION

The present subject matter relates generally to dryer appliances, and more particularly to dryer appliances that utilize a heat pump.

BACKGROUND OF THE INVENTION

A conventional appliance for drying articles such as a clothes dryer (or laundry dryer) for drying clothing articles typically includes a cabinet having a rotating drum for tumbling clothes and laundry articles therein. One or more heating elements heat air prior to the air entering the drum, and the warm air is circulated through the drum as the clothes are tumbled to remove moisture from laundry articles in the drum. Gas or electric heating elements may be used to heat the air that is circulated through the drum.

In a known operation, ambient air from outside is drawn into the cabinet and passed through the heater before being fed to the drum. Moisture from the clothing is transferred to the air passing through the drum. Typically, this moisture laden air is then transported away from the dryer by, for example, a duct leading outside of the structure or room where the dryer is placed. The exhausted air removes moisture from the dryer and the clothes are dried as the process is continued by drawing in more ambient air.

Unfortunately, for the conventional dryer described above, the exhausted air is still relatively warm while the ambient air drawn into the dryer must be heated. This process is relatively inefficient because heat energy in the exhausted air is lost and additional energy must be provided to heat more ambient air. More specifically, the ambient air drawn into the dryer is heated to promote the liberation of the moisture out of the laundry. This air, containing moisture from the laundry, is then exhausted into the environment along with much of the heat energy that was used to raise its temperature from ambient conditions.

One alternative to a conventional dryer as described above is a heat pump dryer. More specifically, a heat pump dryer uses a refrigerant cycle to both provide hot air to the dryer and to condense water vapor in air coming from the dryer. Since the moisture content in the air from the dryer is reduced by condensation over the evaporator, this same air can be reheated again using the condenser and then passed through the dryer again to remove more moisture. Moreover, since the air is recycled through the dryer in a closed loop rather than being ejected to the environment, the heat pump dryer can be more efficient to operate than the traditional dryer described above. In addition, the heating source provided by the sealed refrigerant system of a heat pump dryer can be more efficient than a gas or electric heater implemented in the conventional dryer.

During operation of a typical heat pump dryer, the dryer consumes power. The dryer system will heat continuously during operation. If the amount of power consumed is greater than the rate of heat transfer to the surroundings, the system will heat up. Excessive heat can lead to reduced performance and reliability. More particularly, as air circulates, the temperature of the air within the sealed loop increases. Similarly, the thermal load to the sealed refrigerant system increases. Simply put, the excess heat must go somewhere. In some instances, the thermal load may be reduced or offset by venting hot air into the ambient environment around the dryer appliance to dissipate the excess heat, e.g., to the laundry room, via air exchange. However, this may result in undesired increases in ambient temperature within a living space.

Accordingly, a heat pump dryer appliance having improved thermal energy management would be advantageous.

BRIEF DESCRIPTION OF THE INVENTION

The present invention provides a heat pump dryer appliance configured to reject excess compressor capacity, e.g., thermal energy, to water such as condensate water, as well as related methods of operating a heat pump dryer appliance to reject excess compressor capacity to water. Aspects and advantages of the invention will be set forth in part in the following description, or may be obvious from the description, or may be learned through practice of the invention.

In one exemplary aspect of the present disclosure, a dryer appliance is provided. The dryer appliance may include a cabinet with a drum rotatably mounted within the cabinet. The drum defines a chamber for the receipt of articles for drying. The dryer appliance also includes a sealed refrigerant circuit in thermal communication with the chamber and a condensation tank configured to receive condensate from an evaporator of the sealed refrigerant circuit. The condensate is selectively in thermal communication with a condenser of the sealed refrigerant circuit.

In another exemplary aspect of the present disclosure, a method of operating a dryer appliance is provided. The method may include providing a flow of air from a condenser of a sealed refrigerant circuit to a chamber defined within a drum of the dryer appliance. The method may also include discharging air from the chamber to an evaporator of the sealed refrigerant circuit. The method may further include circulating air from the evaporator to the condenser. When the air passes over and around the evaporator, moisture from the air condenses at the evaporator forming a condensate. The method may include transferring thermal energy from the condenser of the sealed refrigerant circuit to the condensate.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
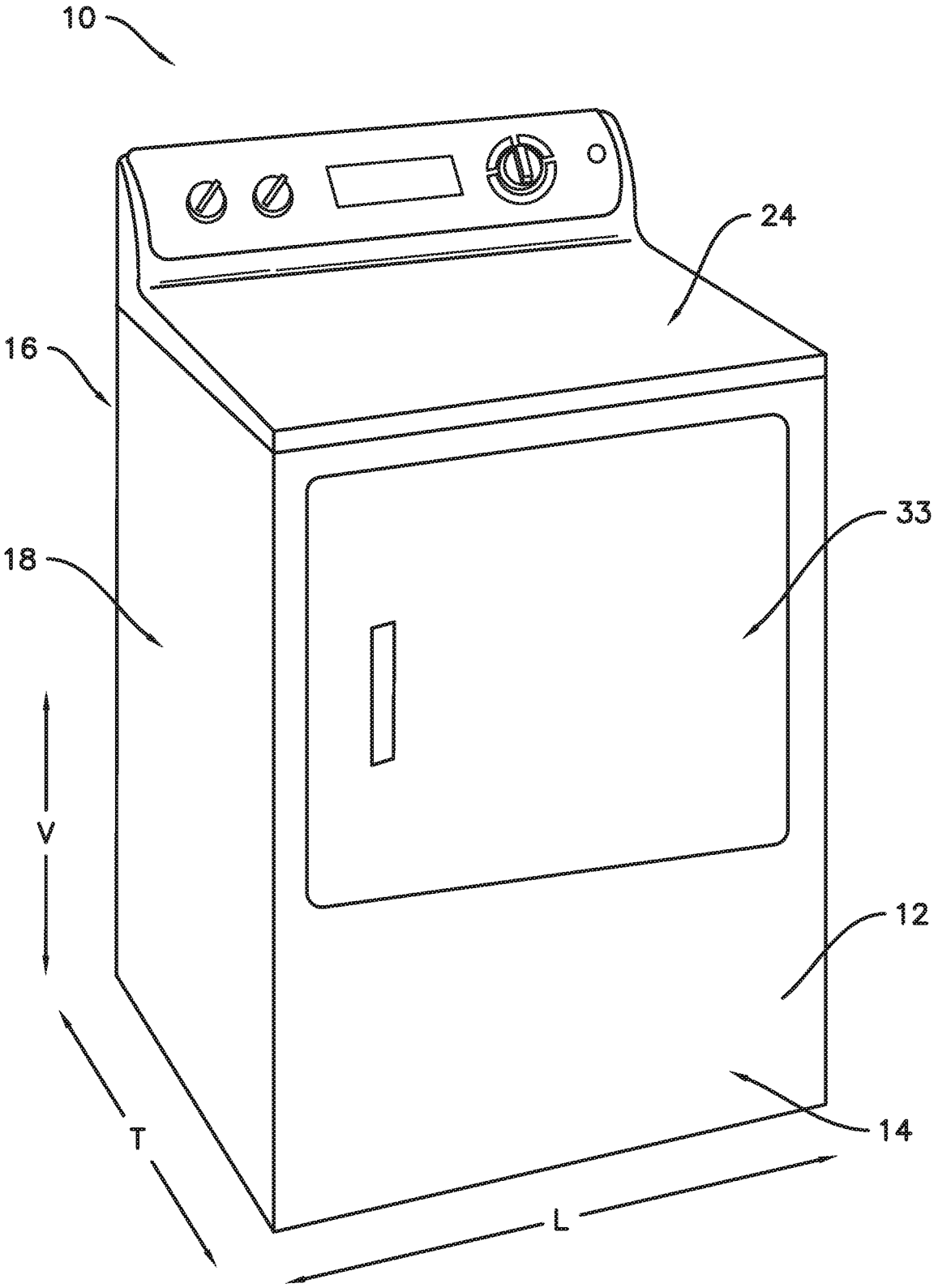
FIG. 1 provides a perspective view of a dryer appliance in accordance with exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
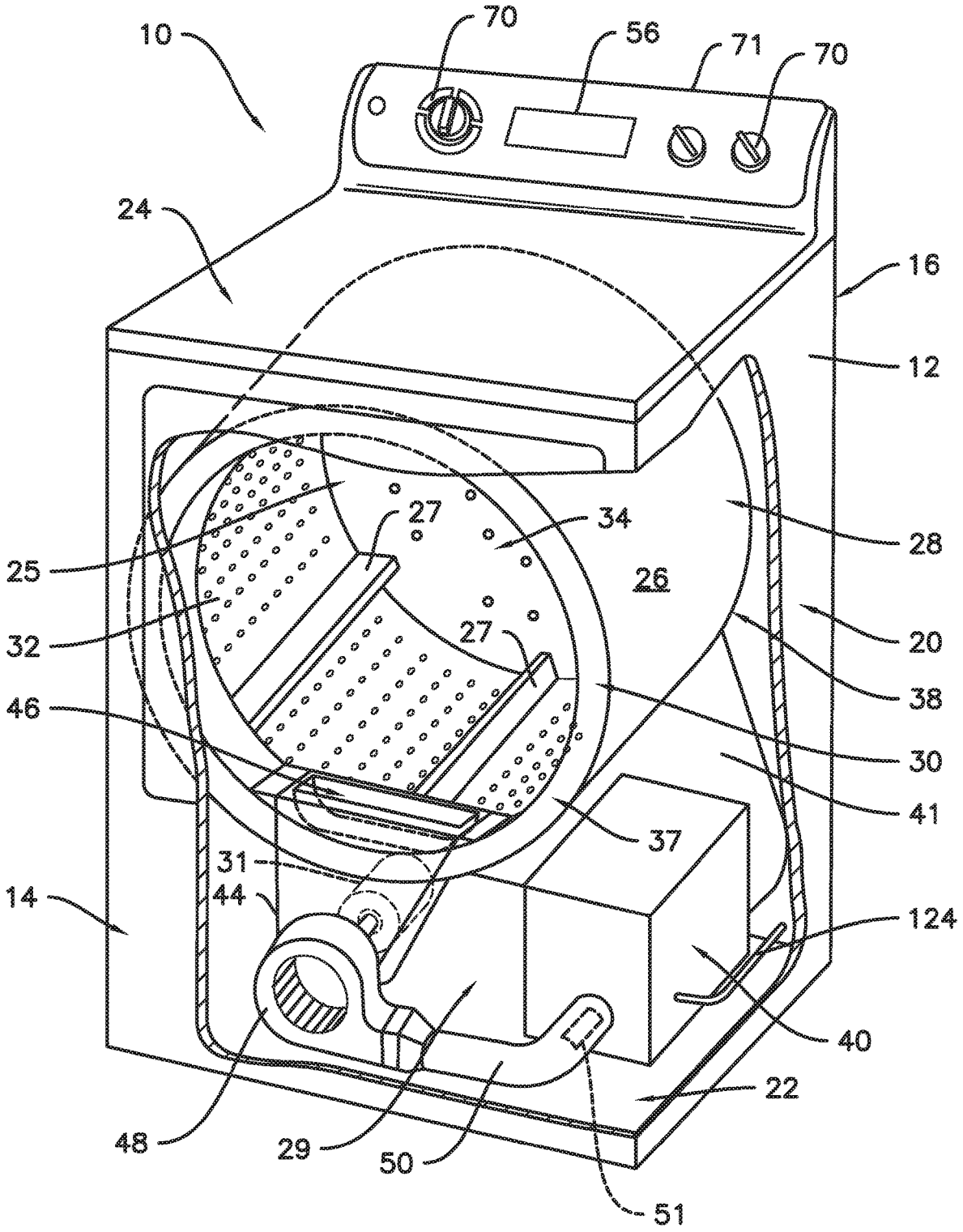
FIG. 2 provides a perspective view of the example dryer appliance of FIG. 1 with portions of a cabinet of the dryer appliance removed to reveal certain components of the dryer appliance.

Turning now to the figures, FIG. 1 provides dryer appliance 10 according to exemplary embodiments of the present disclosure. FIG. 2 provides another perspective view of dryer appliance 10 with a portion of a cabinet or housing 12 of dryer appliance 10 removed in order to show certain components of dryer appliance 10. Dryer appliance 10 generally defines a vertical direction V, a lateral direction L, and a transverse direction T, each of which is mutually perpendicular, such that an orthogonal coordinate system is defined. While described in the context of a specific embodiment of dryer appliance 10, using the teachings disclosed herein, it will be understood that dryer appliance 10 is provided by way of example only. Other dryer appliances having different appearances and different features may also be utilized with the present subject matter as well.

Cabinet 12 includes a front panel 14, a rear panel 16, a pair of side panels 18 and 20 spaced apart from each other by front and rear panels 14 and 16, a bottom panel 22, and a top cover 24. Within cabinet 12, an interior volume 29 is defined. A drum or container 26 is mounted for rotation about a substantially horizontal axis within the interior volume 29. Drum 26 defines a chamber 25 for receipt of articles of clothing for tumbling and/or drying. Drum 26 extends between a front portion 37 and a back portion 38. Drum 26 also includes a back or rear wall 34, e.g., at back portion 38 of drum 26. A supply duct 41 may be mounted to rear wall 34 and receives heated air that has been heated by a heating assembly or system 40.

As used herein, the terms "clothing" or "articles" includes but need not be limited to fabrics, textiles, garments, linens, papers, or other items from which the extraction of moisture is desirable. Furthermore, the term "load" or "laundry load" refers to the combination of clothing that may be washed together in a washing machine or dried together in a dryer appliance 10 (e.g., clothes dryer) and may include a mixture of different or similar articles of clothing of different or similar types and kinds of fabrics, textiles, garments and linens within a particular laundering process.

A motor 31 is provided in some embodiments to rotate drum 26 about the horizontal axis, e.g., via a pulley and a belt (not pictured). Drum 26 is generally cylindrical in shape, having an outer cylindrical wall 28 and a front flange or wall 30 that defines an opening 32 of drum 26, e.g., at front portion 37 of drum 26, for loading and unloading of articles into and out of chamber 25 of drum 26. A plurality of lifters or baffles 27 are provided within chamber 25 of drum 26 to lift articles therein and then allow such articles to tumble back to a bottom of drum 26 as drum 26 rotates. Baffles 27 may be mounted to drum 26 such that baffles 27 rotate with drum 26 during operation of dryer appliance 10.

Drum 26 includes a rear wall 34 rotatably supported within main housing 12 by a suitable fixed bearing. Rear wall 34 can be fixed or can be rotatable. Rear wall 34 may include, for instance, a plurality of holes that receive hot air that has been heated by a heat pump or refrigerant based heating system 40, as will be described further below. Moisture laden, heated air is drawn from drum 26 by an air handler, such as blower fan 48, which generates a negative air pressure within drum 26. The air passes through a duct 44 enclosing screen filter 46, which traps lint particles. As the air passes from blower fan 48, it enters a duct 50 and then is passed into heating system 40. Heating system 40 may be or include a heat pump including a sealed refrigerant circuit, as described in more detail below with reference to FIG. 3. Heated air (with a lower moisture content than was received from drum 26), exits heating system 40 and returns to drum 26 by duct 41. After the clothing articles have been dried, they are removed from the drum 26 via opening 32. A door 33 provides for closing or accessing drum 26 through opening 32.

In some embodiments, one or more selector inputs 70, such as knobs, buttons, touchscreen interfaces, etc., may be provided or mounted on a cabinet 12 (e.g., on a backsplash 71) and are in operable communication (e.g., electrically coupled or coupled through a wireless network band) with a processing device or controller 56. Controller 56 may also be provided in operable communication with motor 31, blower 48, or heating system 40. In turn, signals generated in controller 56 direct operation of motor 31, blower 48, or heating system 40 in response to the position of inputs 70. As used herein, "processing device" or "controller" may refer to one or more microprocessors, microcontroller, ASICS, or semiconductor devices and is not restricted necessarily to a single element. The controller 56 may be programmed to operate dryer appliance 10 by executing instructions stored in memory (e.g., non-transitory media). The controller 56 may include, or be associated with, one or more memory elements such as RAM, ROM, or electrically erasable, programmable read only memory (EEPROM). For example, the instructions may be software or any set of instructions that when executed by the processing device, cause the processing device to perform operations. It should be noted that controllers as disclosed herein are capable of and may be operable to perform any methods and associated method steps as disclosed herein. For example, in some embodiments, methods disclosed herein may be embodied in programming instructions stored in the memory and executed by the controller.

Figure 3:
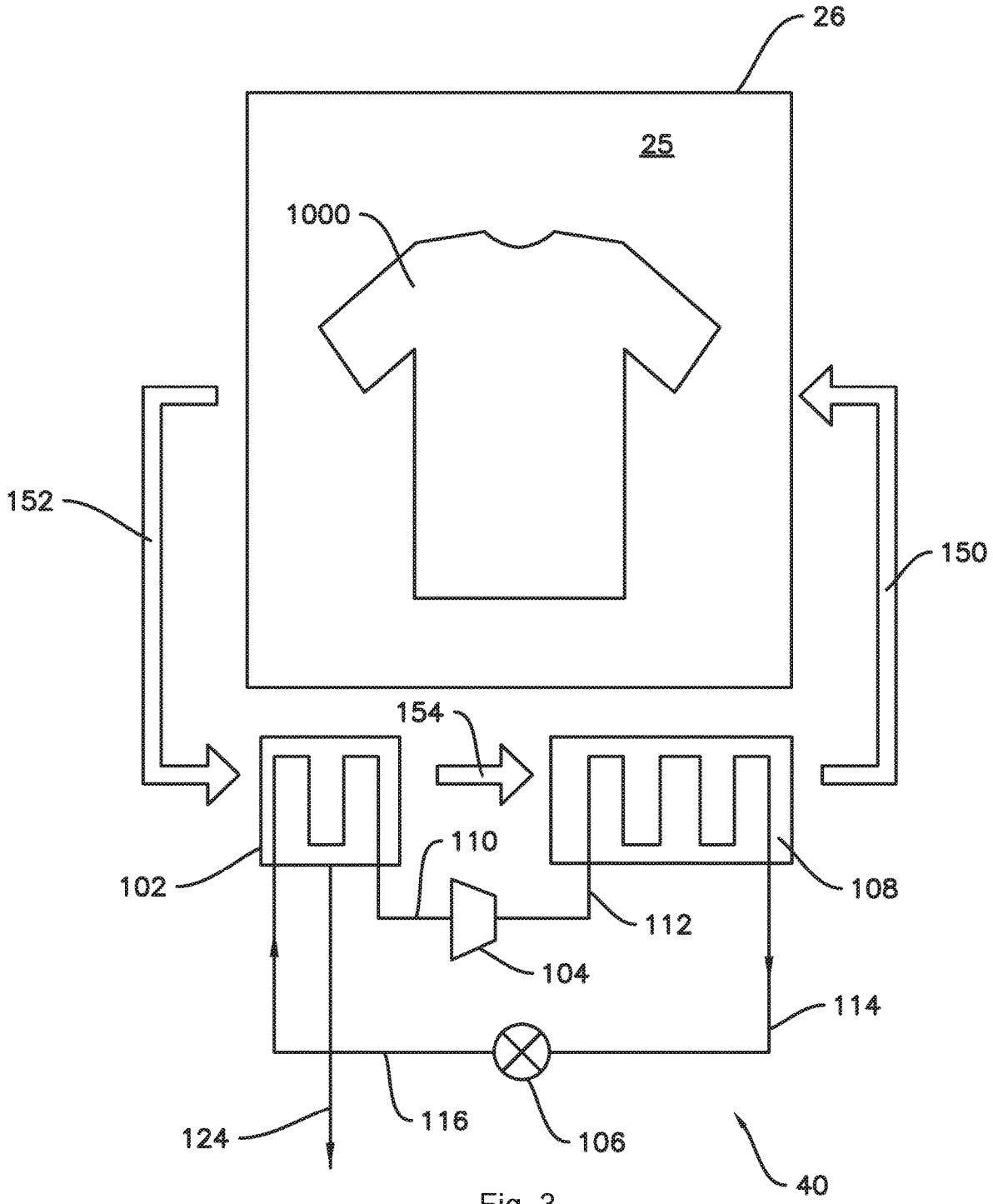
FIG. 3 provides a schematic diagram of an exemplary heat pump dryer appliance according to one or more embodiments of the present disclosure.
Figure 4:
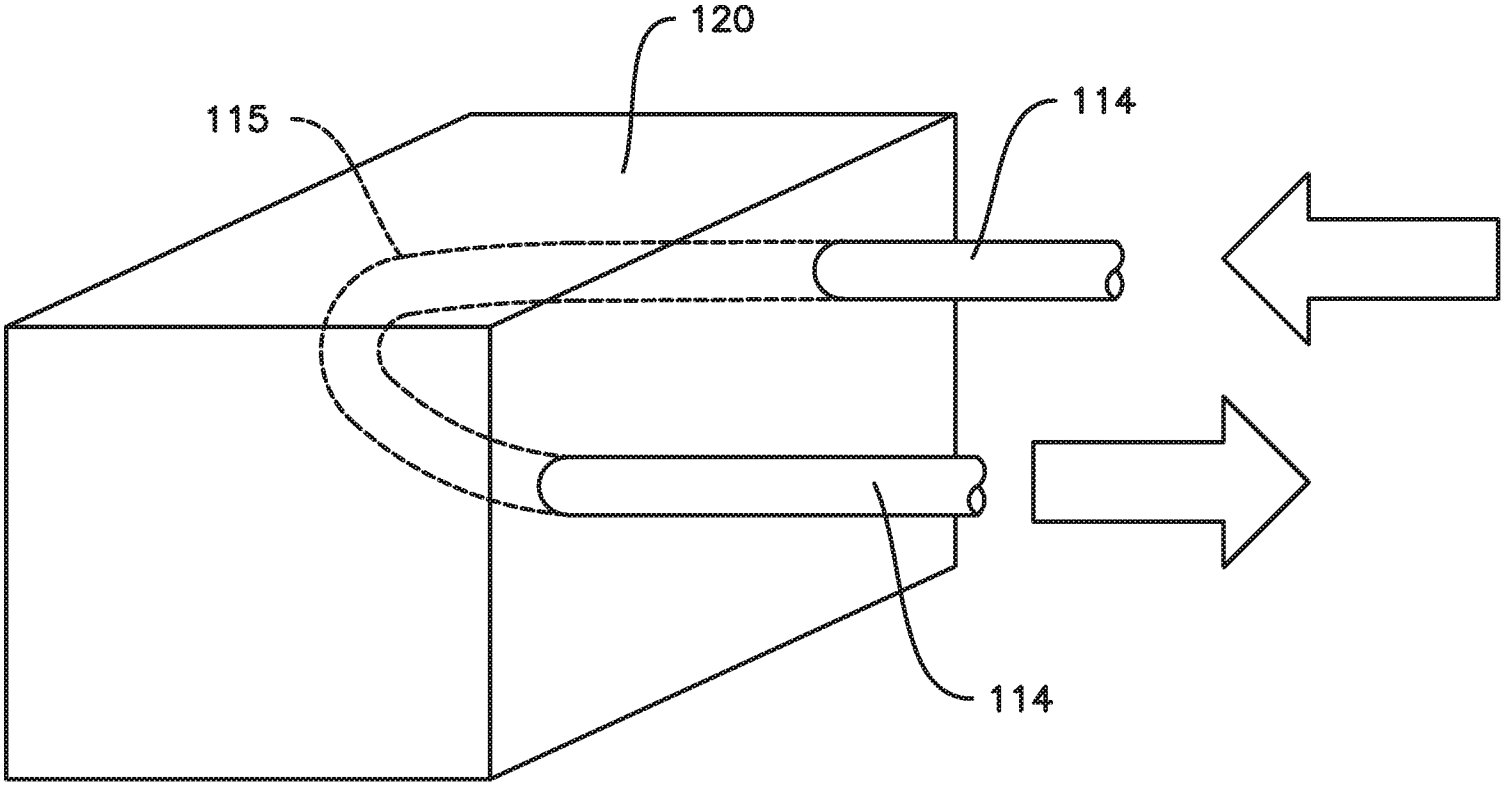
FIG. 4 provides a perspective view of a condensation tank as may be incorporated in a heat pump dryer appliance according to one or more embodiments of the present disclosure.

Turning now to FIG. 3, a schematic view of exemplary embodiments of dryer appliance 10 is provided. It is understood that, except as otherwise indicated, dryer appliance 10 in FIG. 3 may include some or all of the features described above with respect to FIGS. 1 and 2.

In operation, one or more laundry articles 1000 may be placed within the chamber 25 of drum 26. Hot dry air 150 may be supplied to chamber 25 whereby moisture within laundry articles 1000 may be drawn from the laundry articles 1000 by evaporation, such that warm saturated air 152 may flow from chamber 25 to an evaporator 102 of the heating system 40. As air passes across evaporator 102, the temperature of the air is reduced through heat exchange with refrigerant that is vaporized within, for example, coils or tubing of evaporator 102. This vaporization process absorbs both the sensible and the latent heat from the moisture laden air—thereby reducing its temperature. As a result, moisture in the air is condensed and such condensate may be drained from heating assembly 40, e.g., using line 124 which may be seen in FIG. 2.

Air passing over evaporator 102 becomes drier and cooler than when it was received from drum 26 of dryer appliance 10. As shown, cool dry air 154 from evaporator 102 is subsequently caused to flow across a condenser 108 (e.g., across coils or tubing), which condenses refrigerant therein. The refrigerant enters condenser 108 in a gaseous state at a relatively high temperature compared to the air 154 from evaporator 102. As a result, heat energy is transferred to the air at the condenser section 108, thereby elevating its temperature and providing warm dry air 150 for resupply to the drum 26 of dryer appliance 10. The warm dry air 150 passes over and around laundry articles 1000 within the chamber 25 of the drum 26, such that warm saturated air 152 is generated, as mentioned above. Because the air is recycled through drum 26 and heating system 40, dryer appliance 10 can have a much greater efficiency than traditional clothes dryers where warm, moisture laden air is exhausted to the environment.

As shown, some embodiments of heating system 40 include a compressor 104 that pressurizes refrigerant (i.e., increases the pressure of the refrigerant) supplied by suction line 110 and generally motivates refrigerant through the sealed refrigerant circuit of heating system 40. Compressor 104 may be in operable communication with controller 56 and is generally designed to pressurize a gas phase refrigerant. Accordingly, in order to avoid damage, refrigerant in suction line 110 is supplied to the compressor 104 in a gas phase from the evaporator section 102. The pressurization of the refrigerant with compressor 104 increases the temperature of the refrigerant (e.g., as directed by controller 56). The compressed refrigerant is fed from compressor 104 to condenser 108 through line 112. As relatively cool air from the evaporator 102 is passed over the condenser 108, the refrigerant is cooled and its temperature is lowered as heat is transferred to the air for supply to drum 26.

Upon exiting condenser 108, the refrigerant is fed through line 114 to an expansion device 106. Although only one expansion device 106 is shown, such is by way of example only. It is understood that multiple such devices may be used. In the illustrated example, expansion device 106 is a thermal expansion valve. In additional embodiments, any other suitable expansion device, such as a capillary tube, may be used as well as or instead of the thermal expansion valve 106. Expansion device 106 lowers the pressure of the refrigerant and controls the amount of refrigerant that is allowed to enter the evaporator 102 via line 116. Importantly, the flow of liquid refrigerant into evaporator 102 is limited by expansion device 106 in order to keep the pressure low and allow expansion of the refrigerant back into the gas phase in the evaporator 102. The evaporation of the refrigerant in the evaporator 102 converts the refrigerant from its liquid-dominated phase to a gas phase while cooling and drying the air from drum 26. The process is repeated as air is circulated through drum 26 and between evaporator 102 and condenser 108 while the refrigerant is cycled through the sealed refrigerant circuit, as described above.

In some embodiments, the compressor 104 may be a single-speed compressor. In such embodiments, the rate of heat imparted to the refrigerant by the compressor 104 will remain relatively constant throughout operation of the dryer appliance 10. During operation, and as the process described above is repeated, the moisture content of the articles 1000 decreases. Thus, the capacity of the articles 1000 to absorb heat decreases. In embodiments where the compressor 104 is a single-speed compressor, this may result in excess compressor capacity during the dryer operation, e.g., when the laundry is partially dry but not completely dry. Such excess compressor capacity may result in an increased thermal load, e.g., at the condenser 108 downstream of the compressor 104. In order to reduce the thermal load at the condenser 108 during this portion of the drying operation, the condenser 108 may be selectively in thermal communication with condensate 121, as shown in various example embodiments illustrated in FIGS. 5 through 10 and described further below.

Figure 5:
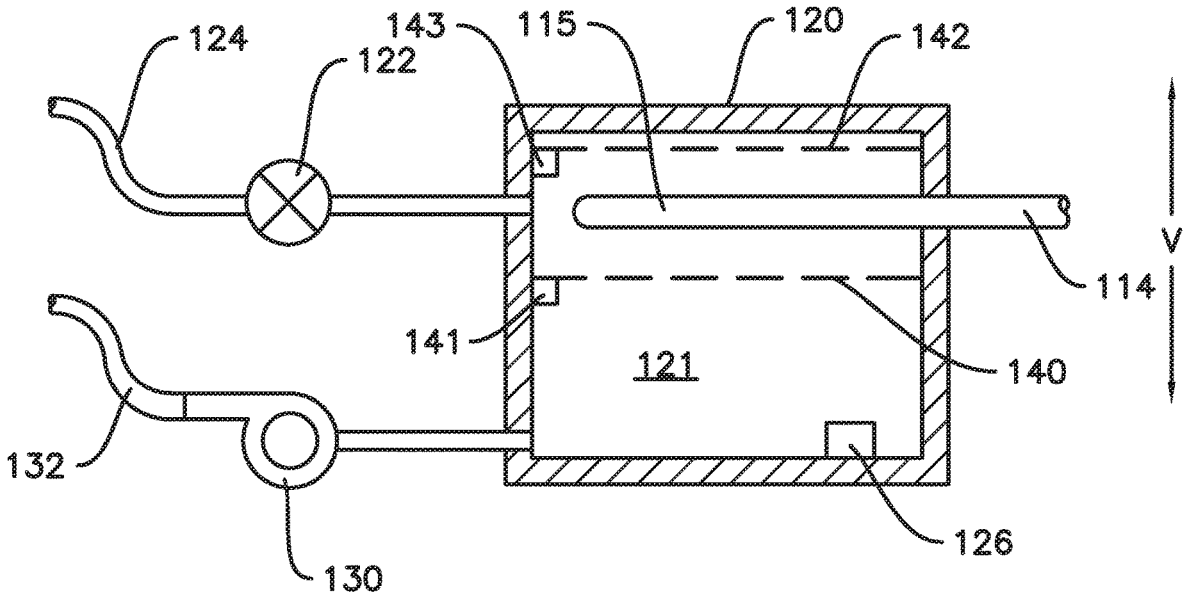
FIG. 5 provides a section view of the condensation tank of FIG. 4 according to at least one embodiment of the present disclosure.
Figure 6:
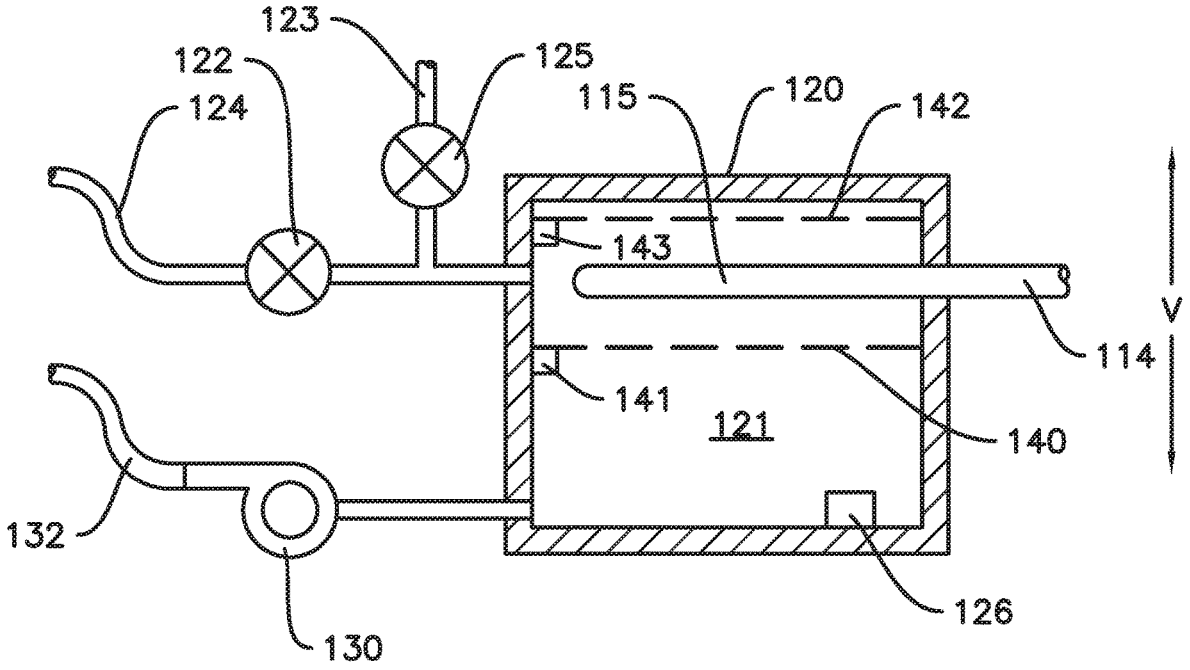
FIG. 6 provides a section view of the condensation tank of FIG. 4 according to at least one additional embodiment of the present disclosure.
Figure 7:
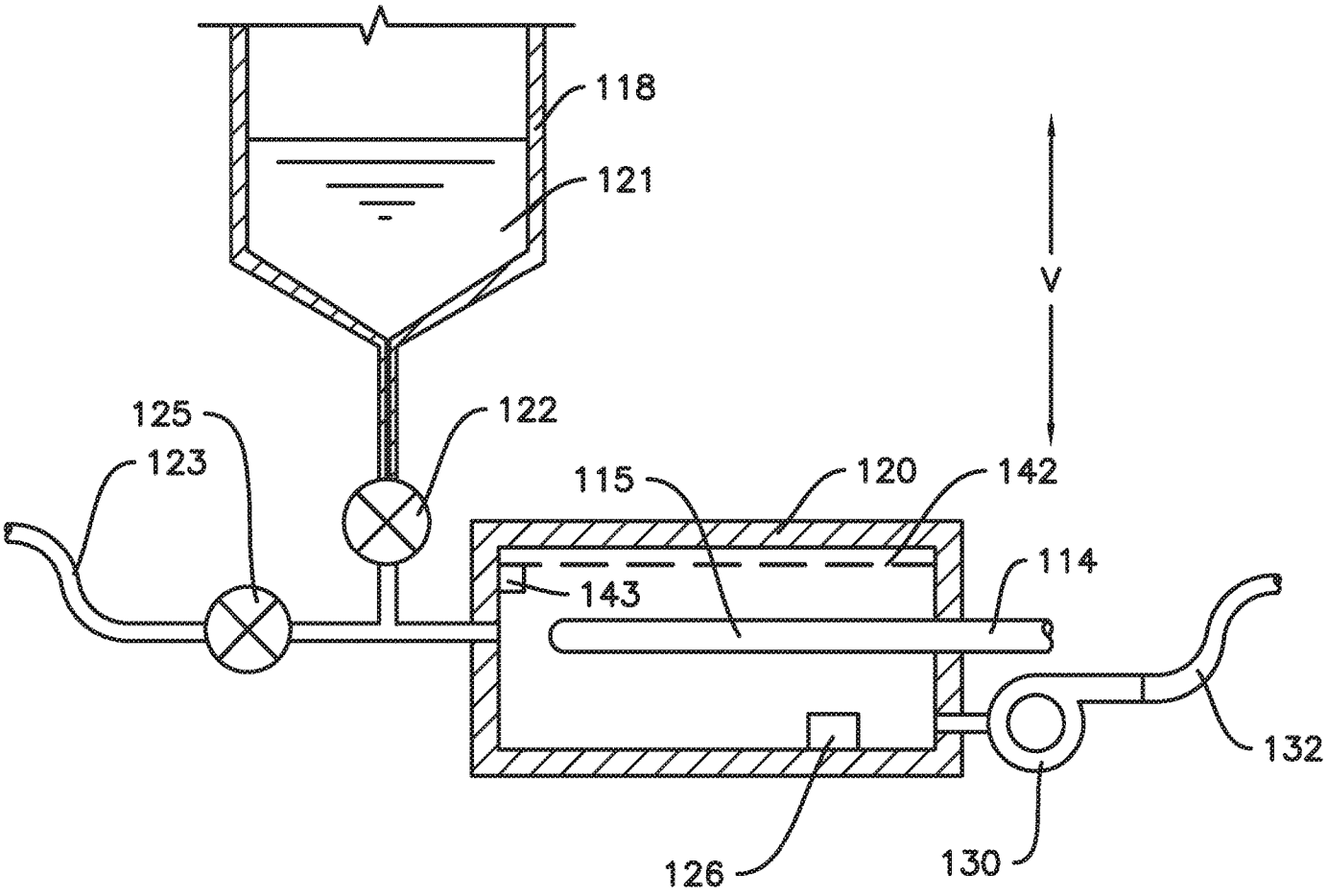
FIG. 7 provides a section view of the condensation tank of FIG. 4 according to at least one additional embodiment of the present disclosure.

As may be seen in FIGS. 4 through 7, the dryer appliance 10 may include a sump or condensation tank 120 configured to receive condensate 121 from the evaporator 102. Condensate from the evaporator 102 may flow into the condensation tank 120 via condensate line 124, e.g., as illustrated in FIGS. 5 and 6. In some embodiments, condensate 121 may be stored in a holding tank 118 upstream of the condensate tank 120 until heat exchange, as described in more detail below, is needed. A heat exchanger 115, in particular a refrigerant to water heat exchanger such as the portion of line 114 illustrated in FIGS. 4 through 7, may be provided in the condensation tank 120. As best seen in FIGS. 5 through 7, the condensate 121 within the condensation tank 120 may be selectively in thermal communication with the condenser 108 via the heat exchanger 115 based on a fill level of the condensate 121 within the condensation tank 120. In some exemplary embodiments, e.g., as shown in FIGS. 5 and 6, the condensate in the condensation tank may be not in thermal communication with the condenser 108 via the heat exchanger 115 when the condensation tank 120 is filled to a first level 140, and the condensate 121 may be in thermal communication with the condenser 108 via the heat exchanger 115 when the condensation tank 120 is filled to a second level 142. In some exemplary embodiments, e.g., as illustrated in FIG. 7, the condensate 121 may be not in thermal communication with the condenser 108 via the heat exchanger 115 when the condensate 121 is held within holding tank 118 and the condensate 121 may be in thermal communication with the condenser 108 via the heat exchanger 115 when the condensation tank 120 is filled, e.g., by gravity flow, when valve 122 is opened. When the condensation tank 120 is filled to a level such that the heat exchanger 115 is submerged, the heat exchanger may be activated such that thermal energy from the condenser 108 may be absorbed by refrigerant within line 114 and transferred to water, e.g., condensate, 121 in the condensation tank 120 when the refrigerant flows through the heat exchanger 115, e.g., the portion of line 114 extending through the condensation tank 120, as illustrated for example in FIGS. 4 through 7. For example, the heat exchanger 115 may be positioned within the condensation tank 120 at a height along the vertical direction V such that when the condensation tank 120 is filled to the first level 140 the heat exchanger 115 is above the condensate 121 and not in direct contact with the condensate 121, and when the condensation tank 120 is filled to the second level 142 (which is greater than the first level 140), the heat exchanger 115 is submerged in the condensate 121 and thereby the heat exchanger 115 is activated as described above.

As seen in FIGS. 5 through 7, a valve 122 may be provided in the condensate line 124 upstream of the condensation tank 120, such as downstream of holding tank 118 and upstream of the condensation tank 120, e.g., as in the embodiment of FIG. 7. In such embodiments, the controller 56 may be in operative communication with the valve 122. Additionally, a temperature sensor 51 (FIG. 2) such as a thermistor or any other suitable temperature sensor may be provided to sense a temperature of the heating system 40. For example, as illustrated in FIG. 2, the temperature sensor 51 may be configured to sense a temperature of air 152 flowing between the chamber 25 and the evaporator 102. In various embodiments, one or more temperature sensors may be provided, and the temperature sensor(s) may also or instead be configured to sense a temperature of refrigerant within the heating system 40 and/or a temperature of a casing within the heating system 40, such as a compressor case. For example, the controller 56 may be configured to open the valve 122 when the sensed temperature, e.g., of air 152, is greater than a predetermined threshold temperature. As mentioned, the sensed temperature may also or instead be a sensed temperature of the refrigerant and/or a case of the compressor 104. In various embodiments, the controller 56 may be configured to open the valve 122 such that the condensation tank 120 is filled to the second level 142. For example, the controller 56 may be configured to open the valve 122 for a predetermined amount of time when the sensed temperature is greater than the predetermined threshold temperature. The predetermined time may be a sufficient amount of time, given a known flow rate of condensate 121 through condensate line 124, to fill condensation tank 120 to the second level 142. In another example, the controller 56 may be in operative communication with a float switch 143 configured to detect when the condensate 121 within condensation tank 120 has reached the second level 142 and the controller 56 may be configured to close the valve 122 upon receiving a signal from the float switch 143 indicating that the condensation tank 120 is filled to the second level 142. In some embodiments, e.g., as shown in FIGS. 5 and 6, the float switch 143 may be a second float switch and a first float switch 141 may be provided to sense when the water, e.g., condensate, 121 has filled the tank 120 to the first level 140. The structure and function of such float switches are understood by those of skill in the art and are not described in further detail herein.

Turning now to FIG. 6, an additional exemplary embodiment is shown wherein water may be provided to the condensation tank 120 as needed, e.g., when condensation is not available in a sufficient quantity to submerge the heat exchanger 115. In the example embodiment illustrated by FIG. 6, a water supply, such as a residential plumbing system, may be in fluid communication with the condensation tank 120 via a conduit 123 with a valve 125 upstream of the condensation tank 120.

As illustrated for example in FIG. 7, in some embodiments the condensate 121 may gradually accumulate in the holding tank 118 during operation of the heating system 40. The condensate 121 may then be stored in the holding tank 118 until needed. For example, the condensate 121 may be stored in the holding tank 118 until the sensed temperature, e.g., of the air 152, refrigerant, and/or compressor 104, is greater than the predetermined threshold temperature, as described above. As shown in FIG. 7, the holding tank 118 may be positioned above the condensate tank 120 along the vertical direction V, such that condensate 121 may flow into the condensate tank 120 from the holding tank 118 by gravity.

Also shown in FIGS. 5 through 7 is a drain pump 130. The drain pump 130 may be in fluid communication with the condensation tank 120 such that the drain pump 130 may extract condensate 121 from the condensation tank 120 and provide a flow of condensate to drain conduit 132. The controller 56 may be in operative communication with the drain pump 130. For example, the controller 56 may be configured to deactivate the drain pump 130 when the sensed temperature of air 152 flowing between the chamber 25 and the evaporator 102 is greater than the predetermined threshold temperature, such that condensate 121 continually flowing into the condensation tank 120 fills the condensation tank 120 to the second level. Additionally, a temperature sensor 126 may be positioned in the condensation tank 120 and configured to sense a temperature of the water, e.g., condensate, in the condensation tank 120. For example, it may be desirable to ensure that the condensate 121 is not excessively heated, e.g., to or above a boiling point. Accordingly, in some embodiments, the controller 56 may also be in operative communication with the temperature sensor 126 to receive a signal from the temperature sensor 126 indicative of the temperature of the condensate 121 in the condensation tank 120. The controller 56 may be further configured to activate the drain pump 130 when the sensed temperature of the condensate 121 in the condensation tank 120 is greater than a predetermined drain temperature. As such, the condensation tank 120 may be completely or substantially drained when the sensed temperature of the condensate 121 in the condensation tank 120 is greater than the predetermined drain temperature, e.g., to a fill level below the first level 140. The condensation tank 120 may be subsequently re-filled, e.g., to an intermediate level between the first level 140 and the second level 142, or to the second level 142 when additional or continued heat exchange is desired after draining the tank 120. In various embodiments, the condensation tank 120 may be re-filled with water from condensate line 124 and/or a water supply such as a residential plumbing system, e.g., as in the embodiment illustrated by FIG. 6. For example, the condensation tank 120 may be re-filled by opening the valve 122 in a similar manner as described above. As another example, as shown in FIG. 6, water supply valve 121 may be provided upstream of the condensation tank 120 to selectively provide water from a residential plumbing system to the condensation tank 120. In such embodiments, the controller 56 may be further configured to open the water supply valve 121 after activating the drain pump 130 such that the condensation tank 120 is re-filled. In some embodiments, the condensation tank 120 may be re-filled with the water supply valve 121 to an intermediate level greater than the first level 140 and less than the second level 142.

Figure 8:
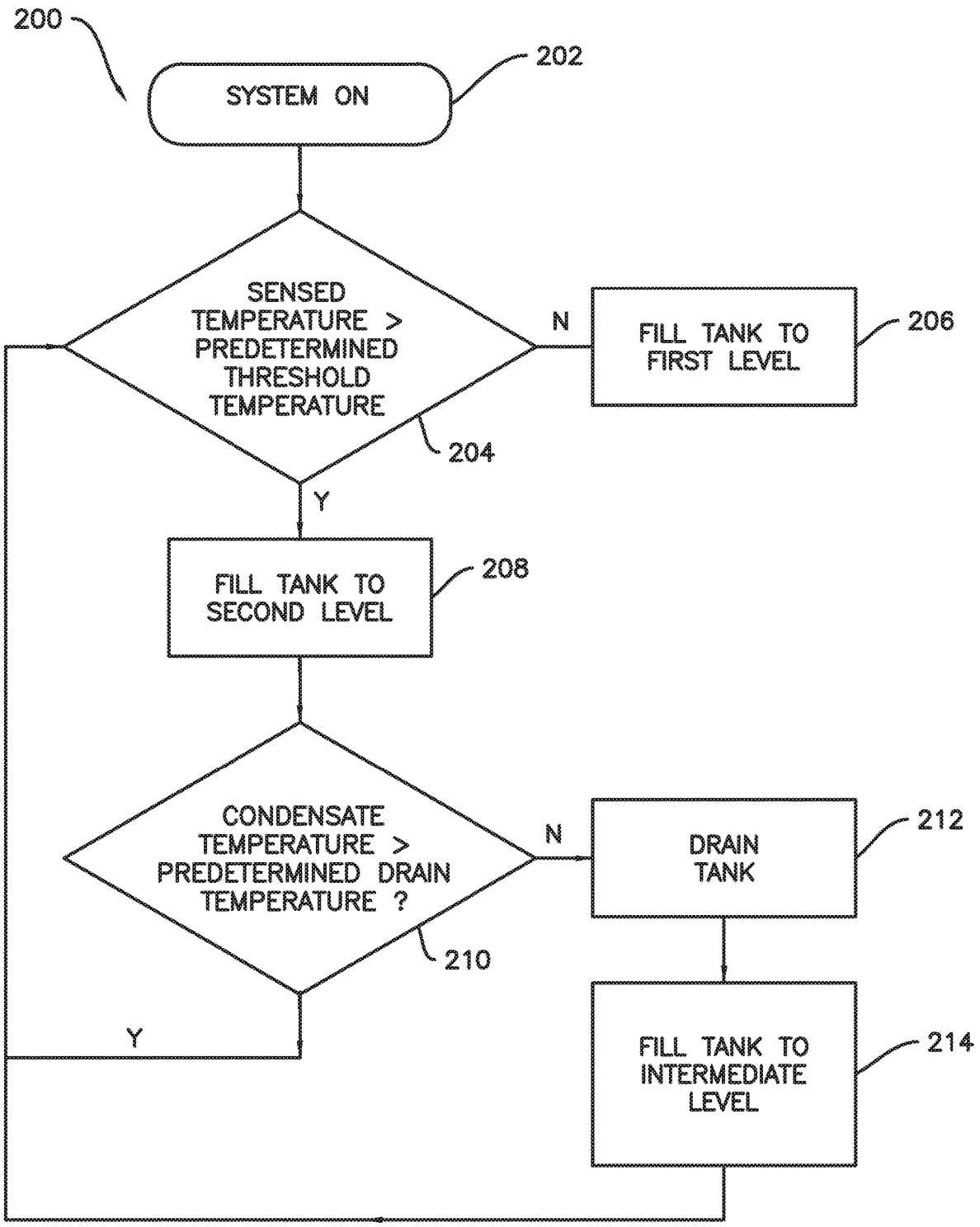
FIG. 8 provides a flow chart of an exemplary method of operating a heat pump dryer appliance according to one or more embodiments of the present disclosure.

FIG. 8 provides a flow chart of an exemplary method 200 of operating a dryer appliance according to one or more additional embodiments of the present disclosure. Method 200 may begin with an initial step 202 of turning the system on. During operation, as described above, the dryer appliance 10 may provide the flow of air 150 from the condenser 108 to the chamber 25 and discharge the air 152 from the chamber 25 to the evaporator 102. Operation of the dryer appliance 10 may also include circulating air 154 from the evaporator 102 to the condenser 108, and, as mentioned above, moisture from the air 152 may condense at the evaporator 102 before the air 154 is circulated to the condenser 108. Further, the exemplary steps in FIG. 8 illustrate one embodiment in which the method 200 includes transferring thermal energy from the condenser 108 to the condensate 121. As mentioned above, a temperature sensor 51 (FIG. 2) may be provided for sensing a temperature of the heating system 40, e.g., of air 152 discharged from the chamber 25 to the evaporator 102. Accordingly, the method 200 may include determining, at step 204, whether the sensed temperature is greater than the predetermined threshold temperature. As mentioned, the sensed temperature may be any one or more of an air temperature, a refrigerant temperature, or a surface temperature, e.g., of a surface of the compressor 104. In such embodiments, condensate 121 may be collected in the condensation tank 120, e.g., via condensate line 124, so as to fill the condensation tank 120 to the first level 140 at step 206 when the sensed temperature is less than the predetermined threshold temperature. Condensate 121 may be collected in the condensation tank 120 so as to fill the condensation tank 120 to the second level 142 at step 208 when the sensed temperature is greater than the predetermined threshold temperature. As mentioned above, the heat exchanger 115 in the condensation tank 120 is activated when the condensation tank 120 is filled to the second level 142. Additionally, in some embodiments, the method 200 may continually monitor the temperature, e.g., of the air 152, refrigerant within the heating system 40, and/or the compressor 104. Thus, for example, the method 200 may also include returning to step 204 after filling the condensation tank 120 to the first level 140 at step 206.

Method 200 may further include sensing a temperature of the condensate 121 in the condensation tank 120, e.g., with a temperature sensor such as sensor 126 in FIGS. 5 through 7, and determining, at step 210, whether the sensed condensate temperature is less than a predetermined drain temperature. Method 200 may also include draining the condensation tank 120 at step 212 when the sensed temperature of the condensate 121 in the condensation tank 120 is greater than or equal to (e.g., not less than) the predetermined drain temperature. After draining the condensation tank 120 at step 212, the method 200 may also include a step 214 of re-filling the tank 120, e.g., to an intermediate level greater than the first level and less than the second level, as described above. For example, the intermediate fill may be provided with condensate from condensate line 124 and/or from a separate water supply. As mentioned above, the method 200 may continually monitor the temperature of the air 152. Accordingly, in some embodiments, the method 200 may return to step 204 after step 210 and/or step 214.

Figure 9:
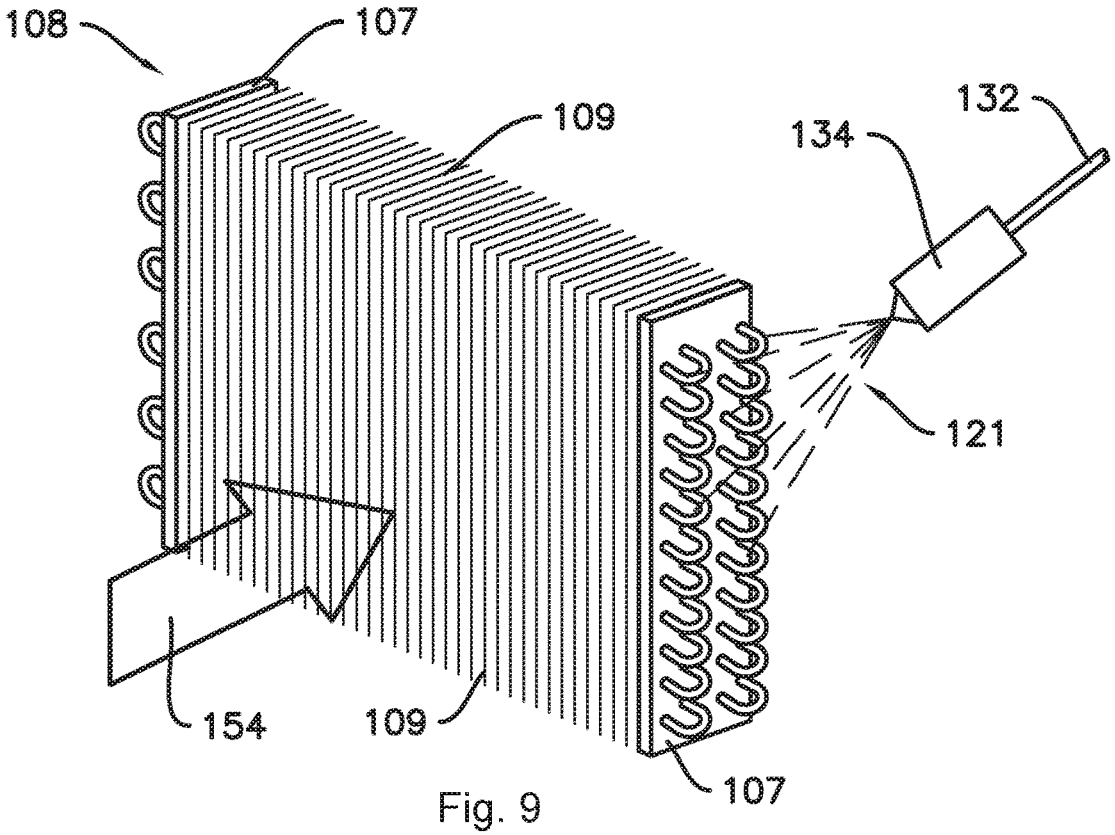
FIG. 9 provides a perspective view of a condenser in thermal communication with condensate of a heat pump dryer appliance according to one or more embodiments of the present disclosure.
Figure 10:
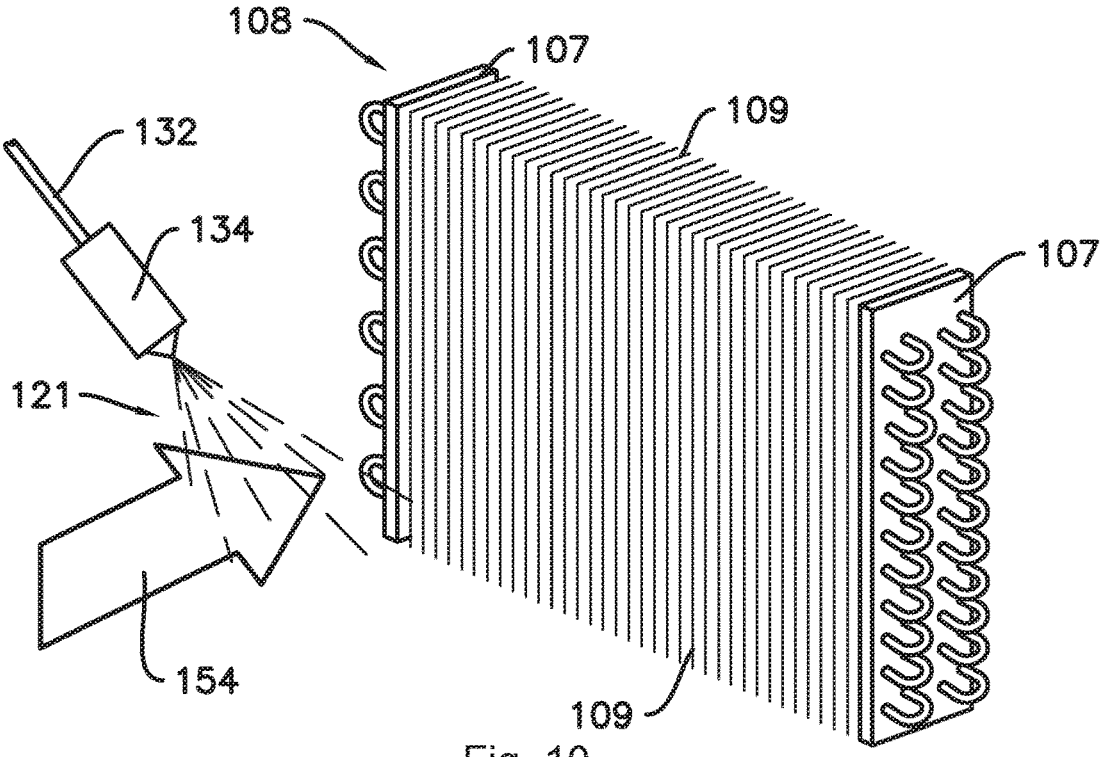
FIG. 10 provides a perspective view of a condenser in thermal communication with condensate of a heat pump dryer appliance according to one or more additional embodiments of the present disclosure.

FIGS. 9 and 10 illustrate additional embodiments, wherein the drain pump 130 may supply water, e.g., condensate 121, from the tank 120 to a spray head 134 via conduit 132. The drain pump 130 may supply the condensate 121 from the condensate tank 120 or from condensate line 124. In various embodiments, the spray head 134 may be configured to spray the condensate 121 on the condenser 108 such that the condensate 121 may directly absorb thermal energy from the condenser 108. Accordingly, additional embodiments of the present disclosure may include methods of operating the dryer appliance 10 wherein thermal energy is transferred from the condenser 108 to the condensate 121 by spraying the condensate 121 on the condenser 108. As may be seen in FIGS. 9 and 10, the condenser 108 may include a plurality of fins 109 (only selected fins 109 are specifically numbered for sake of clarity) extending between a pair of end panels 107. One of ordinary skill in the art will understand that air 154 flows between and around the fins 109, and the fins 109 are configured to provide an optimal surface area for heat exchange between the air 154 and refrigerant within the condenser 108. Accordingly, as shown in FIG. 9, in some embodiments the spray head 134 may be configured to spray the condensate 121 on one or the end panels 107 of the condenser 108, such that the condensate does not enter the air 154. Additional exemplary embodiments of the present disclosure include methods of operating the dryer appliance 10 which comprise spraying the condensate 121 on one of the end panels 107. In other embodiments, as shown in FIG. 10, the spray head 134 may be configured to spray the condensate 121 on the plurality of fins 109 of the condenser 108. Thus, additional exemplary embodiments of the present disclosure include methods of operating the dryer appliance 10 which comprise spraying the condensate 121 on the plurality of fins 109 of the condenser 108. Spraying the condensate 121 on one of the end panels 107 may advantageously prevent introducing additional humidity into the chamber 25, e.g., via air 150. Spraying the condensate 121 on the plurality of fins 109 may advantageously provide increased contact between the condensate 121 and the condenser 108 to more rapidly transfer thermal energy from the condenser 108 to the condensate 121.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance comprising:

a cabinet;

a drum rotatably mounted within the cabinet, the drum defining a chamber for the receipt of articles for drying;

a sealed refrigerant circuit in thermal communication with the chamber;

a condensation tank configured to receive condensate from an evaporator of the sealed refrigerant circuit, the condensate selectively in thermal communication with a condenser of the sealed refrigerant circuit;

a refrigerant to water heat exchanger in the condensation tank, wherein the condensate in the condensation tank is selectively in thermal communication with the condenser via the refrigerant to water heat exchanger in the condensation tank such that the condensate in the condensation tank is not in thermal communication with the condenser via the refrigerant to water heat exchanger in the condensation tank when the condensation tank is filled to a first level and the condensate in the condensation tank is in thermal communication with the condenser via the refrigerant to water heat exchanger in the condensation tank when the condensation tank is filled to a second level greater than the first level;

a condensation line extending between the evaporator of the sealed refrigerant circuit and the condensation tank;

a valve in the condensation line upstream of the condensation tank; and a controller in operative communication with the valve, the controller configured to open the valve when a sensed temperature of air flowing between the chamber of the drum and the evaporator of the sealed refrigerant circuit is greater than a predetermined threshold temperature, whereby the condensation tank is filled to the second level.

2. The dryer appliance of claim 1, further comprising a drain pump in fluid communication with the condensation tank, wherein the controller is further in operative communication with the drain pump, the controller configured to deactivate the drain pump when a sensed temperature of air flowing between the chamber of the drum and the evaporator of the sealed refrigerant circuit is greater than a predetermined threshold temperature, whereby the condensation tank is filled to the second level.

3. The dryer appliance of claim 2, wherein the controller is further configured to activate the drain pump when a sensed temperature of the condensate in the condensation tank is greater than a predetermined drain temperature.

4. The dryer appliance of claim 3, further comprising a water supply valve upstream of the condensation tank, wherein the controller is further configured to open the water supply valve after activating the drain pump, whereby the condensation tank is filled to an intermediate level greater than the first level and less than the second level.

5. The dryer appliance of claim 1, further comprising a drain pump in fluid communication with the condensation tank, the drain pump configured to supply condensate from the condensation tank to a spray head, the spray head configured to spray the condensate on the condenser of the sealed refrigerant circuit.

6. The dryer appliance of claim 5, wherein the spray head is configured to spray the condensate on an end panel of the condenser.

7. The dryer appliance of claim 5, wherein the spray head is configured to spray the condensate on a plurality of fins of the condenser.

8. A method of operating a dryer appliance, comprising:

providing a flow of air from a condenser of a sealed refrigerant circuit to a chamber defined within a drum of the dryer appliance;

discharging air from the chamber to an evaporator of the sealed refrigerant circuit;

circulating air from the evaporator to the condenser, wherein moisture from the air condenses at the evaporator forming a condensate;

transferring thermal energy from the condenser of the sealed refrigerant circuit to the condensate via a heat exchanger in a condensation tank;

sensing a temperature of the air discharged from the chamber to the evaporator;

collecting the condensate in the condensation tank by filling the condensation tank to a first level when the sensed temperature is less than a predetermined threshold temperature and filling the condensation tank to a second level greater than the first level when the sensed temperature is greater than the predetermined threshold temperature, whereby the heat exchanger in the condensation tank is activated when the condensation tank is filled to the second level.

9. The method of claim 8, further comprising sensing a temperature of the condensate in the condensation tank, and draining the tank when the sensed temperature of the condensate in the condensation tank is greater than a predetermined drain temperature.

10. The method of claim 9, further comprising filling the tank with a water supply to an intermediate level greater than the first level and less than the second level after draining the tank.

11. The method of claim 8, wherein the step of transferring thermal energy comprises spraying the condensate on the condenser of the sealed refrigerant circuit.

12. The method of claim 8, wherein the step of transferring thermal energy comprises spraying the condensate on an end panel of the condenser.

13. The method of claim 8, wherein the step of transferring thermal energy comprises spraying the condensate on a plurality of fins of the condenser.

* * * * *